US005106066A

United States Patent [19]

Shea et al.

[11] Patent Number: 5,106,066

[45] Date of Patent: Apr. 21, 1992

[54] STAPLING SYSTEM FEED MECHANISM

[75] Inventors: Robert H. Shea, Victor; Steven M. Russel, Pittsford, both of N.Y.

[73] Assignee: Eastman Kodak Company, Rochester, N.Y.

[21] Appl. No.: 607,927

[22] Filed: Nov. 1, 1990

[51] Int. Cl.[5] ..... B41L 43/12; B26D 5/38

[52] U.S. Cl. ..... 270/37; 83/370; 227/2; 227/90; 227/140; 227/131; 270/53

[58] Field of Search ..... 227/1, 84, 86, 88, 2, 227/90, 131, 2; 83/370; 270/37, 53

[56] References Cited

U.S. PATENT DOCUMENTS

| | | | |
|---|---|---|---|
| 1,883,047 | 10/1932 | Spire | 83/370 X |
| 1,942,069 | 1/1934 | Setoguchi et al. | 83/370 |
| 2,441,837 | 5/1948 | Ness et al. | 83/370 X |
| 2,554,691 | 5/1951 | Zeruneith . | |
| 2,779,407 | 1/1957 | Thomsen | 83/370 X |
| 3,747,825 | 7/1973 | Barland | 227/90 |
| 4,318,555 | 3/1982 | Adamski et al. | 283/7 |
| 4,369,908 | 1/1983 | Harvey | 227/90 |
| 4,416,046 | 1/1983 | Stokes | 29/417 |
| 4,449,661 | 5/1984 | Spehrley, Jr. | 227/155 |
| 4,516,713 | 5/1985 | Meijer | 227/1 |
| 4,546,910 | 10/1985 | Logtens | 227/155 |
| 4,898,314 | 2/1990 | Stroh | 227/84 X |
| 4,901,431 | 2/1990 | Gast | 227/2 X |
| 5,018,656 | 5/1991 | Phelps | 227/84 |

*Primary Examiner*—Frank T. Yost
*Assistant Examiner*—Kenneth E. Peterson
*Attorney, Agent, or Firm*—Tallam I. Nguti

[57] ABSTRACT

A stapling system for stapling a set of copy sheets in a copier or printer includes a precise, but non-metering continuous wire feed mechanism. The feed mechanism has a full-feed wire sensor, and a control circuit including the wire being fed, for sensing and controlling the feeding of precise lengths of continuous staple wire to the stapler head of the system.

10 Claims, 4 Drawing Sheets

STAPLING SYSTEM FEED MECHANISM

CROSS-REFERENCE TO RELATED APPLICATIONS

This application is related to the following applications filed on even date herewith:

1. U.S. application Ser. No. 608,098, filed in the names of Robert H. Shea et al and entitled "STAPLING SYSTEM WORK CLAMP."
2. U.S. application Ser. No. 608,116, filed in the names of Robert H. Shea et al and entitled "STAPLING SYSTEM HAVING NOISE REDUCING WORK CLAMP."
3. U.S. application Ser. No. 607,930, filed in the names of Robert H. Shea et al and entitled "STAPLING SYSTEM HAVING A HYBRID CLINCHER ASSEMBLY."
4. U.S. application Ser. No. 607,929, filed in the names of Robert H. Shea et al and entitled "STAPLER HEAD HAVING WIRE PATH DEFINING COVER."

BACKGROUND OF THE INVENTION

1. Field of the Invention

This invention relates, in general, to electrostatographic copiers and printers, and more particularly, to a stapling apparatus in such a copier or printer for binding a stacked set of copy sheets.

2. Background of the Invention

Electrostatographic copiers and printers are well known. As is known, each such copier or printer can produce a series of precollated copy sheets which can then be compiled by an attached finisher portion of such printer or copier into a stacked set of sheets for binding together. As disclosed in commonly assigned U.S. Pat. No. 4,318,555 issued Mar. 9, 1982 in the name of Adamski et al, the use generally of a stapling system or apparatus to effect such binding is also well known.

Typically, such a stapling system or apparatus utilizes either preformed staples, or a continuous supply of staple material, such as staple wire, from which a desired length thereof can be cut for forming into a staple. Generally, for stapling copy sheets in copiers and printers, a stapling apparatus which utilizes a continuous supply of staple material is preferred because it can be more versatile, more economical, and more efficient than a similar apparatus which utilizes preformed staples.

However, stapling apparatus utilizing a continuous supply of stapling material ordinarily require additional mechanisms including mechanisms for metering the precise length of staple material desired for forming a staple. Such additional mechanisms are costly. For example, they may include feed wheels or feed rollers for effecting such metering as disclosed, for example, in U.S. Pat. No. 4,318,555. Unfortunately, metering mechanisms as those disclosed in the '555 patent may tend to undesirably overfeed or underfeed staple material during such metering. Additionally, such metering mechanisms also may tend, at the end of each feed cycle, to create undesirable tension in the staple material being metered, thereby resulting in frequent jams and misfeeds within the stapler unit of the apparatus.

SUMMARY OF THE INVENTION

It is an object of the present invention to provide in an electrostatographic copier or printer, a stapling system that prevents overfeeding and underfeeding of continuous staple material therein.

It is another object of the present invention to provide in an electrostatographic copier or printer, a stapling system that utilizes a continuous supply of staple material without the cost and disadvantages of additional mechanisms for metering such staple material.

In accordance with the present invention, a stapling system in an electrostatographic copier or printer is provided for binding a set of copy sheets together using staples. The system comprises a stapling mechanism and a non-metering feed mechanism for feeding continuous staple material to the stapling mechanism.

The non-metering feed mechanism includes means for holding the continuous supply of staple material, means further including an electrical motor for advancing the staple material towards the stapling mechanism, and electrical control circuit means connected to the advancing means for initiating, and for stopping the advancing means. The control circuit means includes the staple material being fed, a first staple material sensor which is mounted in the stapling mechanism for sensing when the predetermined length of continuous staple material has been fed into the stapling mechanism by the advancing means, and means for then responsively stopping the advancing means.

BRIEF DESCRIPTION OF THE DRAWINGS

In the detailed description of the invention presented below, reference is made to the accompanying drawings, in which.

DETAILED DESCRIPTION OF THE PREFERRED EMBODIMENT

Figure 1:
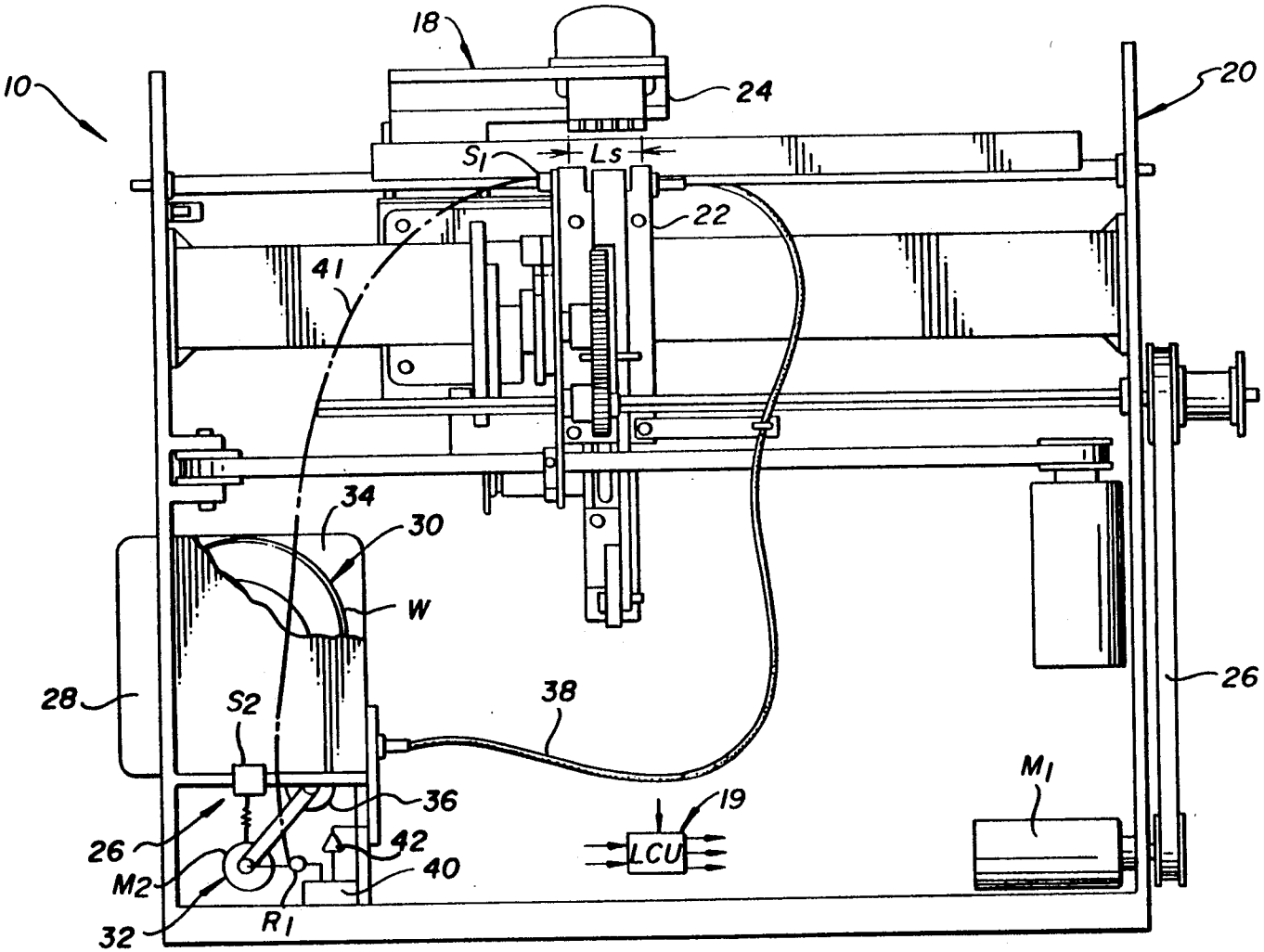
FIG. 1 is an end elevational view of the finisher portion of an electrostatographic copier or printer including the stapling system of the present invention.
Figure 2:
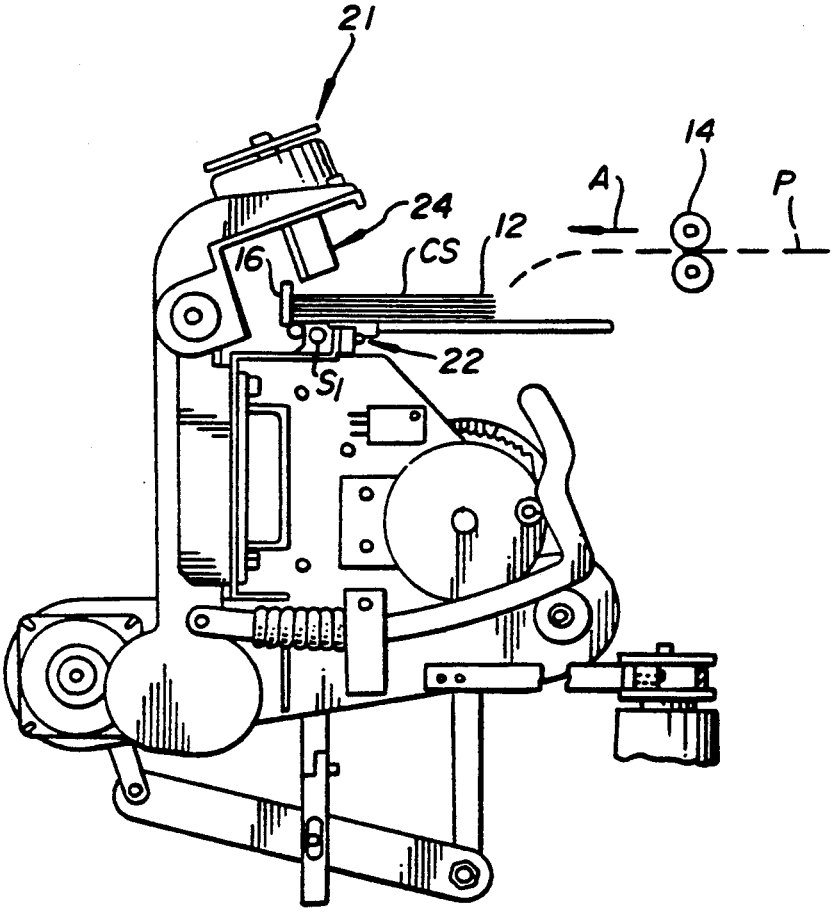
FIG. 2 is a front elevational view of the stapling mechanism of the present invention.

Referring now to FIGS. 1 and 2 of the accompanying drawings, the finisher portion of an electrostatographic copier or printer is designated generally as 10. The finisher 10 is located relative to a receiving tray 12 that is positioned to accumulate copy sheets CS from a copier or printer. The copy sheets CS, for example, are traveling in the direction of arrow A along a sheet travel path P. As shown, a transport mechanism, such as driven nip rollers 14, delivers the sheets CS seriatim to the tray 12. Each sheet is registered in the tray 12 along one of its edges against a pivotable gate 16, thereby compiling the sheets into a stack. The finisher 10 is positioned transverse to the travel path P, and includes a stapling system 18 which is operatively associated with the registered edge of the sheets CS so as to be capable of binding such sheets together along such edge using staples.

As shown in FIG. 1, the stapling system 18 includes a main drive such as a motor $M_1$, and is controlled by a logic and control unit 19. The logic and control unit 19 includes, for example, a microprocessor which receives input and timing signals, for example, from the transport mechanism 14, and from other components of the finisher 10. Based on such signals, and on a program from the microprocessor, the unit 19 produces signals to control the operation of the finisher 10, and that of the stapling system 18.

Referring now to FIGS. 1 and 2, the finisher 10 includes a frame 20 on which the stapling system 18 is supported. As shown, the stapling system 18 which utilizes a continuous supply of wire comprises a stapling mechanism 21 which includes drive means such as a motor $M_1$ and a stapler unit 22. The stapler unit 22 further includes means for shearing the predetermined length Ls of continuous staple wire W, and means for forming from such length Ls, a staple that has a crown portion and leg portions. The stapler unit 22 further includes means for driving the leg portions of the formed staple through a set of sheets CS, and a clincher device 24 for clinching the leg portions against such set CS.

In the present invention, the stapling system 18 also comprises a non-metering staple wire feed mechanism 26 for feeding a desired length Ls of continuous staple wire W to the stapler unit 22 without overfeeding or underfeeding. As shown, the wire feeding mechanism 26 comprises means such as a remotely mounted cassette 28 for holding a continuous supply of staple wire W in coil 30, and means 32 for advancing a length of the wire W from the cassette 28. The cassette 28 is loaded simply by plugging it into a complimentary receiving chamber 34 which is formed in the frame 20 in a position conveniently and safely accessible to an operator. The feeding mechanism 26 further comprises means, including the LCU 19, and a first, full-feed wire sensor $S_1$ located within the stapler unit 22, for controlling the wire advancing means 32 so as to stop such means 32 when a desired and precise length Ls of staple wire has been fed into the stapler unit 22.

As shown, the wire advancing means 32 includes a non-metering wire feed wheel 36 and a flexible wire conduit cable 38 which is connected to the stapler unit 22 as well as to a portion of the frame 20. The cable 38 receives wire W from the cassette 28 and guides it to the stapler unit 22. The wheel 36 is driven by drive means such as a motor $M_2$. The means 32 also includes a switch $S_2$ connected to the motor $M_2$ for sensing the absence or presence of a cassette 28 within the chamber 34.

Power for the motor $M_2$ is provided, for example, by a 24-volt-source power supply 40 that is connected to the motor $M_2$ via a shut-off relay $R_1$. As shown, the relay $R_1$ is also connected by means 41 to the full-feed wire sensor $S_1$ located in the stapler unit 22. In the present invention, the coil 30 as well as the wire W being fed therefrom through the cable 38 are also electrically energized, for example, by a 5-volt electrical potential derived from the power source 40 via a transformer 42. The energized wire W which is being fed into the stapler unit 22 is therefore capable of forming a closed electrical shut-off circuit with the full-feed wire sensor $S_1$, means 41, and relay $R_1$, for shutting off the wire feed motor $M_2$.

Figure 3:
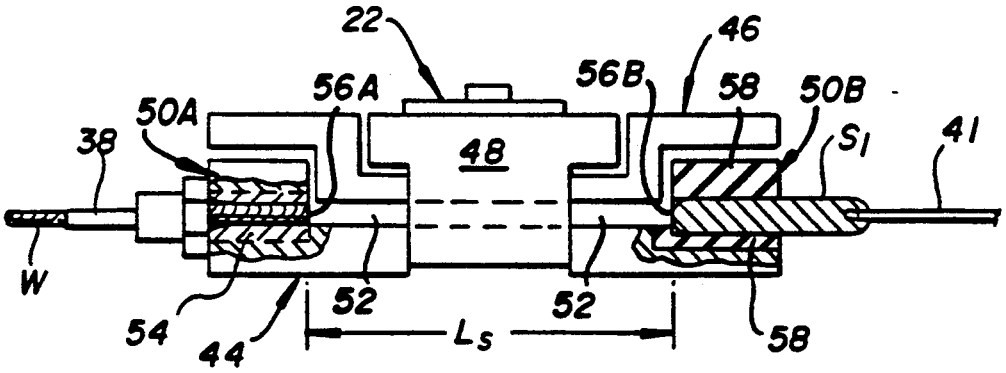
FIG. 3 is an end view, partially cut out and sectioned for detail, of the stapler unit of the stapling mechanism showing the first staple material sensor within the stapling mechanism, and staple material fed to a first position therein.

Referring now to FIG. 3, an end view of the stapler unit 22 is shown, partially cut out and sectioned for detail. As shown, the stapler unit 22 includes a metallic base 44 and a cover 46 to which is mounted an anvil 48. The base 44 is slotted so as to form first and second jaw sections 50A and 50B, respectively, as shown. The cover 46, the anvil 48 and other components of the stapler unit 22 define a wire path 52 from the first jaw portion 50A across the slot, and to the second jaw portion 50B thereof.

As shown, the wire conduit cable 38 is connected to the jaw portion 50A such that wire W fed by the advancing means 32 will enter and pass through such portion 50A. Within the jaw portion 50A, the wire path 52 is fitted with a hardened drilled bushing 54 which is used cooperatively with shearing means for shearing the length Ls of wire W. Inside the stapler unit 22, the leading tip of the wire W being fed thereinto can be stopped at a first position shown as 56A on the inside surface of the jaw portion 50A, and at a second position shown as 56B on the inside of the second jaw portion 50B. The stapling system 18 is designed such that when the tip of the staple wire W is fed from the first position 56A to the second position 56B, a predetermined and precise length Ls of the wire will be available between the jaw portions 50A and 50B respectively.

Figure 4:
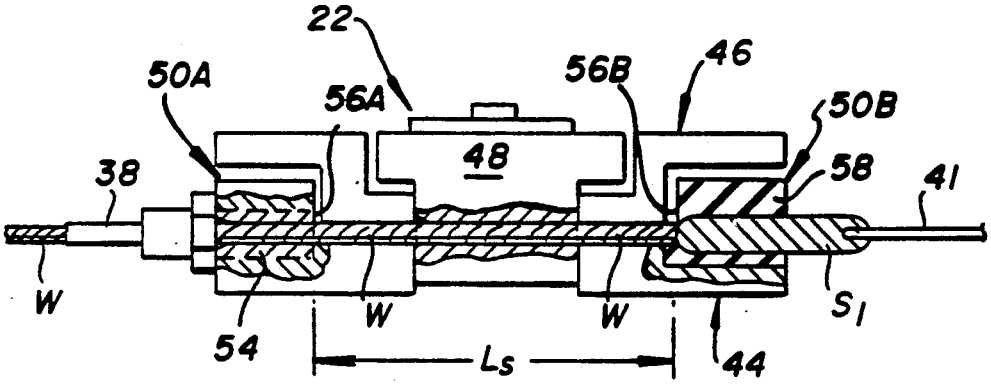
FIG. 4 is the same view as in FIG. 3 but showing the staple material fed to a second, and sensor-contacting position.

As described above, with respect to FIG. 1, the staple wire W, which is conductive, is connected to an electrical potential source, for example, a 5-volt source through the transformer 42. As such, the wire W is live and forms part of the shut-off circuit for the advancing means 32. The shut-off circuit, which also includes the shut-off relay $R_1$ and full-feed wire sensor $S_1$, is designed such that the advancing means 32 is activated when the circuit is open, but is immediately shut off or de-activated when the circuit is closed. As shown in FIG. 4, the shut-off circuit will be closed immediately when the tip of the live wire W makes contact with the full-feed wire sensor $S_1$. Such contact accordingly means that a predetermined length Ls of wire is now available within the head 22, and is ready for shearing.

As further shown, the sensor $S_1$ is mounted within the second jaw portion 50B of the unit 22 to be directly across from the busing 54 in the wire path 52. One end of the sensor $S_1$ forms the second stop position 56B for the tip of wire W, while the other end of $S_1$ is connected by conductive means 41 back to the shut-off relay $R_1$. Because the base 44 of the stapler unit 22 is metallic, sensor $S_1$ is therefore also electrically isolated and insulated by a non-conductive material such as a plastic 58.

Figure 5:
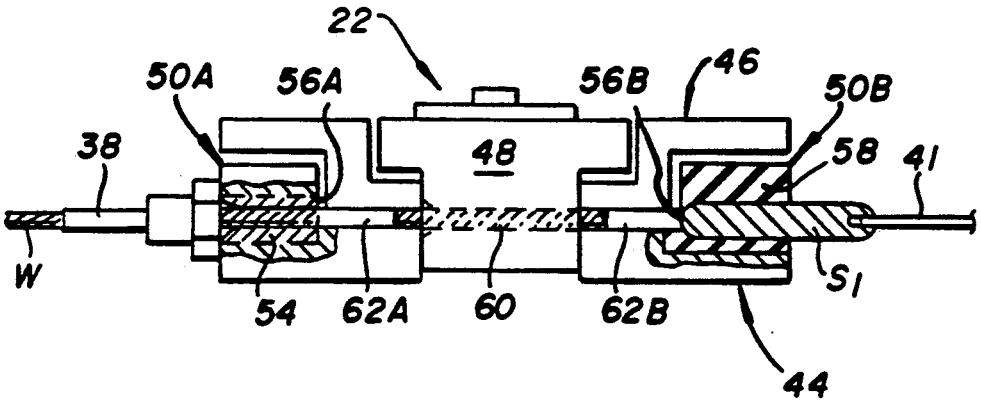
FIG. 5 is the same view as FIGS. 3 and 4 but showing a staple, formed from a sheared predetermined length of the staple material, about to be driven into a set of sheets.

Once the tip of the live wire W contacts the sensor $S_1$, thereby indicating the feeding of the predetermined and precise length Ls between the jaw portions 50A and 50B, the advancing means 32 may be immediately shut off. Thereafter, a staple 60 can then be formed from the length Ls as shown in FIG. 5. To form the staple, the length Ls is first sheared at the hardened bushing 54, for example, by a shearing member 62A which then, together with the anvil 48, and with an opposite member 62B, forms the staple 60 about the anvil. The shut-off circuit meanwhile remains closed until the formed staple 60 is driven by means (not shown) into a set of sheets CS, and until the members 62A, 62B are reset.

Note that at this point, the leading tip of the live wire W will again be at the first point 56A, and that the shut-off circuit is still open and hence the advancing means 32 is activated and ready, for feeding another predetermined length Ls across the stapler unit 22.

As can be seen, the continuous wire feeding mechanism 26 of the stapling system 18 does not include additional, and often expensive metering mechanisms for feeding the desired length Ls. Such metering mechanisms, of course, may tend to overfeed or underfeed, resulting in jams and misfeeds. The feed mechanism 26 of the present invention provides convenient and safe remote loading and unloading of continuous staple wire by means of the cassette 28. Its use of a full-feed electrical sensor $S_1$, and of an electrical shut-off circuit which includes the wire being fed virtually eliminates conditions which conventionally could result in wire underfeed or overfeed, and in undesirable tension in the fed wire.

Figure 6:
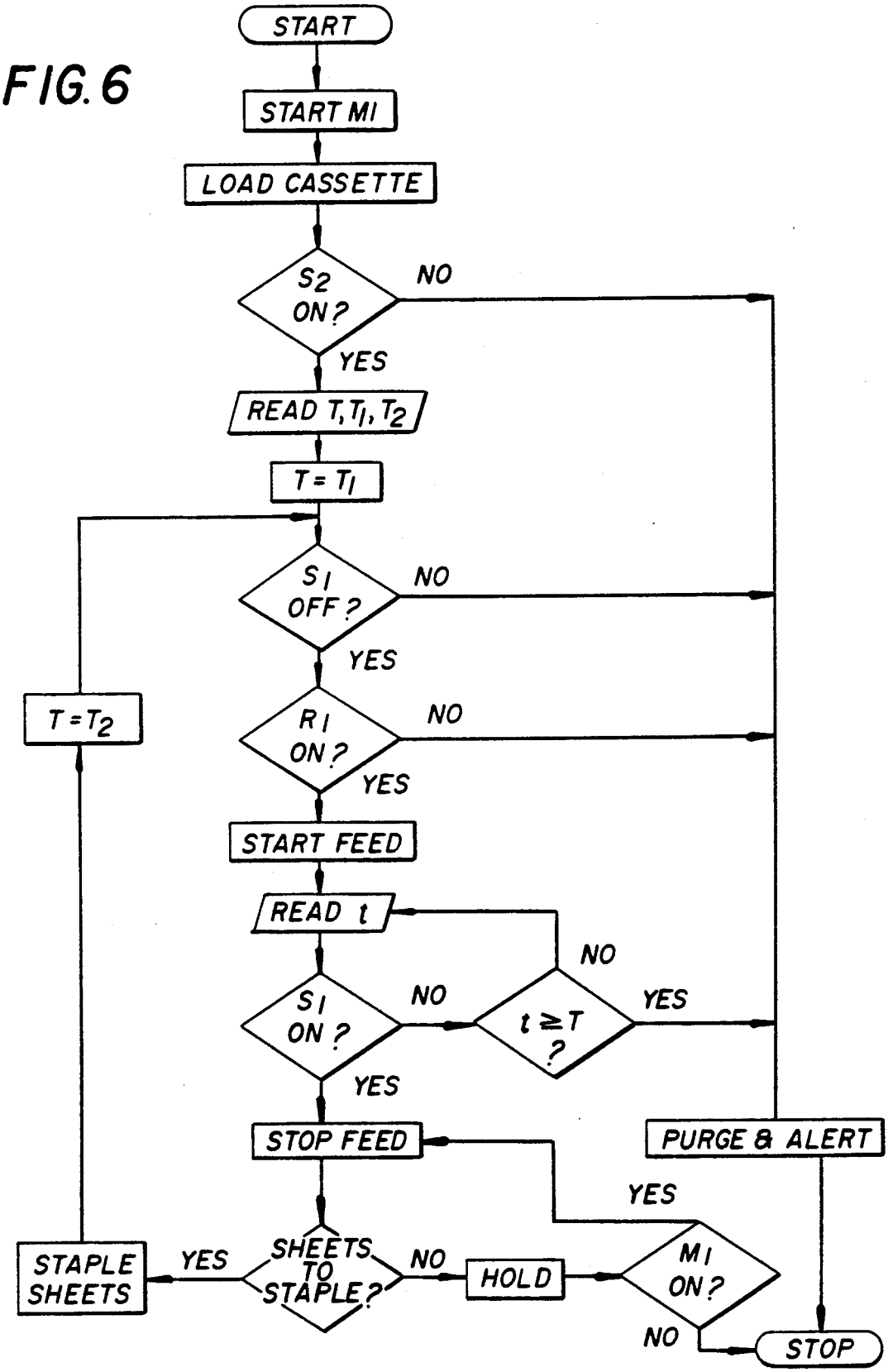
FIG. 6 is a flow chart of the operation, control and automatic purging features of the stapling system of the present invention.

Another advantage of the mechanism 26 is that an operator never needs to touch the staple wire W. This advantage and an automatic self-purging feature of the system are illustrated in the operation flowchart of FIG. 6. Referring now to FIG. 6, the stapling system 18 is ready for operation when the copier or printer and the finisher portions 120 are running.

With the stapling system ready as such for operation, loading the cassette 28 into the chamber 34 should turn on the switch $S_2$. If the switch $S_2$ fails, a program in the (LCU) logic and control unit 19 will stop the system and cause appropriate means such as a flashing light or a sound, as are well known, to alert an operator. Normally, the switch $S_2$ will be turned on. The LCU 19 will then immediately read T, a predetermined time standard, which can either be $T_1$ or $T_2$. $T_1$ is the predetermined time standard for the advancing means 32 to feed the leading tip of the live wire W, from the cassette 28 through the cable 38, past the first position 56A within the stapler unit 22, across the anvil slot therein, and into contact with the full-feed sensor $S_1$ at the second position 56B. Thereafter, $T_2$ is similar time but just for the tip of the wire to go from position 56A, across the slot to position 56B. Before actual wire feeding as such is started however, the shut-off circuit should be open as described above, and that means, $S_1$ should be off and the shut-off relay $R_1$ should be in its shut-off state, for example, ON. Any failure here, again, will result in the stoppage of the system and an alerting of the operator.

With $S_1$ OFF, and $R_1$ ON as indicated, the wire advancing means 32 including the drive motor $M_2$ will be turned on to start feeding wire from the cassette towards the sensor $S_1$. Actual feeding time is "t", and as long as "t" is less than T as read above, and the sensor $S_1$ has not been contacted by the tip of the wire W, the advancing means 32 will continue to feed such wire. As soon as the tip of the wire makes contact with $S_1$ turning $S_1$ on, the shut-off circuit will be closed thereby shutting off the motor $M_2$ and immediately stopping any further feeding of wire W into the stapler unit 22. A precise length Ls of wire would have by then been fed into the stapler unit. For such electrical contact between the wire W and sensor $S_1$, a mere touching is sufficient, thereby eliminating conditions which could conventionally result in undesirable tension in the wire W.

Stoppage of the means 32 also means that the predetermined and precise length Ls is available between the jaw portions 50A and 50B for shearing and use in forming the staple 60. If a set of sheets CS is ready for stapling, the stapling mechanism 21 will staple such a set as described above and then reset, ready for the next stapling cycle.

After the initial feed of the tip of the wire from the cassette 28 to the wire sensor $S_1$, subsequent feeds will involve the tip of the wire W moving merely from the first position 56A to the second position 56B within the stapler unit 22. The predetermined time for each such subsequent feed is $T_2$ which, as expected, is less than $T_1$. Therefore, after the initial feed, T is reset equal to $T_2$, and thereafter the system operates just as described above to feed the predetermined length Ls across the jaw portions 50A, 50B for use in stapling a set of sheets CS.

As shown, such stapling will ordinarily end when the stapling drive means $M_1$ is turned off. It can also end, given any of the failure modes discussed above or, additionally, when the cassette has run out of wire.

In the present invention, when the cassette is out of wire, or if there is a jam within the cable 38, the full-feed wire sensor $S_1$ will not be contacted and turned on within the predetermined time $T_1$ or $T_2$. In that case, "t" will be equal to, or greater than, T while $S_1$ still has not been contacted. As shown, the system will automatically purge itself, alert the operator, and then stop. Such purging, for example, includes stopping and reversing the advancing means 32 in order to pull any wire within the stapler unit 22 and within the cable 38, back into the cassette 28. An operator thereafter can easily unplug the empty or defective cassette from the chamber 34 without ever touching the wire W.

The invention has been described in detail with particular reference to presently preferred embodiments, but it will be understood that variations and modifications can be effected within the spirit and scope of the invention.

What is claimed is:

1. A finishing apparatus for receiving and binding a plurality of sheets from an electrostatographic copier or printer, the finishing apparatus including:

a frame;

means for moving such sheets seriatim along a path;

means for compiling a plurality of such sheets into a set; and a stapling system for binding such a set of sheets together using staples, said stapling system comprising:

(a) a stapling mechanism including (i) drive means, (ii) means for shearing a predetermined length of continuous staple material from a supply thereof, (iii) means for forming from said predetermined length a staple having a crown portion and leg portions, (iv) means for driving said leg portions of said staple through such a set of sheets, and (v) means for clinching such driven leg portions against the set of sheets;

(b) a non-metering feed mechanism for feeding said predetermined length of staple material to said stapling mechanism, said feed mechanism including (i) means for holding a continuousa supply of the staple material; (ii) means including a flexible conduit cable and an elecrical motor for advancing said staple material towards said stapling mechanism; (iii) electrical control circuit means connected to said advancing means for initiating and for stopping said advancing means, said control circuit means including the staple material being advanced, circuit powering means including a low electrical potential source of about 5 volts, a first staple material sensor mounted in said stapling mechanism for sensing when said predetermined length of continuous staple material has been fed into said stapling mechanism by said advancing means, and means for responsively then stopping said advancing means; and (c) means based on staple material feeding time for detecting staple material feed-failure.

2. The finishing apparatus of claim 1 further including a logic and control unit for controlling the various operations of said stapling mechanism and of said non-metering staple material feed mechanism.

3. A stapling system in an eletrostatographic copier or printer for binding a set of copy sheets together using staples, the stapling system comprising:

(a) a stapling mechanism including (i) means for shearing a predetermined length of continuous staple mmaterial from a supply thereof, (ii) means for forming from said predetermined length a staple having a crown portion and leg portions, (iii) means for driving said leg portions of said staple through such a set of sheets, and (iv) means for clinching such driven leg portions against the set of sheets;

(b) a non-metering feed mechanism for feeding said predetermined length of staple material to said stapling mechanism, said feed mechanism including (i) means for holding a continuous supply of the staple material (ii) means including a flexible conduit cable for guiding the staple material and an electrical motor for advancing said staple material towards said stapling mechanism; (iii) electrical control circuit means connected to said advancing means for initiating and for stopping said advancing means, said control circuit means including the staple material being advanced, a first sensor mounted in said stapling mechanism for determining when said predetermined 'ength of staple material has been fed by said advancing means, and means for responsively then stopping said advancing means; and (c) logic and control unit controlled means based on staple material feed time for detecting staple material feed-failure.

4. The stapling system of claim 3 wherein said means for holding a continuous supply of staple material includes a remotely mountable cassette containing such staple material on a spool.

5. The stapling system of claim 3 wherein said advancing means further includes a non-metering feed wheel connected to said electical motor, an idler roller cooperating with said feed wheel, and a conduit cable forming a path for conducting said staple material from said holding means to said stapling mechanism.

6. The stapling system of claim 3 wherein said control circuit means further includes a shut-off relay connected to said electrical motor for automatically shutting off said electrical motor.

7. The stapling system of claim 3 wherein said staple material is staple wire.

8. The stapling system of claim 3 further including means for automatically purging staple material from said stapling mechanism and from said wire advancing means in response to said detection of staple material feed-failure.

9. In a staple material feeding mechanism having staple material advancing means, electrical control circuit means for controlling the feeding of staple material, the control circuit means including:

(a) circuit powering means including a low electrical potential source of about 5 volts;

(b) a contact sensor mounted within a jaw of a stapler head;

(c) a circuit closing member consisting of staple material being energized by said low electrical potential source, and being advanced by the advancing means, said staple material being advanced operating to stop the advancing means when advanced into a circuit closing contact with said sensor;

(d) logic and control unit controlled means based on staple material feed time for detecting staple material feed-failure.

10. The control circuit means of claim 9 including a shut-off relay connected to said sensor and said circuit powering means.

* * * * *